US009163195B2

(12) United States Patent
Nakao et al.

(10) Patent No.: US 9,163,195 B2
(45) Date of Patent: Oct. 20, 2015

(54) LUBRICANT COMPOSITION

(71) Applicant: JX NIPPON OIL & ENERGY CORPORATION, Tokyo (JP)

(72) Inventors: Hajime Nakao, Yokohama (JP); Shozaburo Konishi, Yokohama (JP); Toshio Yoshida, Yokohama (JP)

(73) Assignee: JX NIPPON OIL & ENERGY CORPORATION, Tokyo (JP)

( * ) Notice: Subject to any disclaimer, the term of this patent is extended or adjusted under 35 U.S.C. 154(b) by 0 days.

(21) Appl. No.: 14/279,500

(22) Filed: May 16, 2014

(65) Prior Publication Data

US 2014/0249060 A1 Sep. 4, 2014

Related U.S. Application Data

(63) Continuation of application No. 12/933,805, filed as application No. PCT/JP2009/054778 on Mar. 12, 2009, now abandoned.

(30) Foreign Application Priority Data

Mar. 27, 2008 (JP) ..... 2008-084307
Mar. 27, 2008 (JP) ..... 2008-084377

(51) Int. Cl.
*C10M 137/04* (2006.01)
*C10M 137/08* (2006.01)
*C10M 141/10* (2006.01)
*C10M 169/04* (2006.01)

(52) U.S. Cl.
CPC ..... *C10M 137/04* (2013.01); *C10M 137/08* (2013.01); *C10M 141/10* (2013.01); *C10M 169/04* (2013.01); *C10M 2203/1025* (2013.01); *C10M 2215/04* (2013.01); *C10M 2223/04* (2013.01); *C10M 2223/043* (2013.01); *C10N 2220/025* (2013.01); *C10N 2230/02* (2013.01); *C10N 2230/43* (2013.01); *C10N 2240/40* (2013.01)

(58) Field of Classification Search
USPC ..... 508/433, 545
See application file for complete search history.

(56) References Cited

U.S. PATENT DOCUMENTS

| | | | | |
|---|---|---|---|---|
| 2004/0224860 | A1 | 11/2004 | Baba et al. | |
| 2006/0223721 | A1* | 10/2006 | Sullivan et al. | 508/433 |
| 2006/0229214 | A1* | 10/2006 | Wu et al. | 508/279 |
| 2008/0058235 | A1* | 3/2008 | Takigawa et al. | 508/564 |
| 2008/0312115 | A1 | 12/2008 | Ribeaud | |
| 2011/0021394 | A1 | 1/2011 | Nakao et al. | |

FOREIGN PATENT DOCUMENTS

| | | | |
|---|---|---|---|
| EP | 711822 | A2 | 5/1996 |
| JP | 6-100880 | | 4/1994 |
| JP | 8-134488 | A | 5/1996 |
| JP | 8-291187 | A | 11/1996 |
| JP | 9-137181 | A | 5/1997 |
| JP | 2002-302689 | A | 10/2002 |
| JP | 2003-171684 | A | 6/2003 |
| JP | 2005-187646 | A | 7/2005 |

(Continued)

OTHER PUBLICATIONS

U.S. Appl. No. 12/812,524 to Shigeki Matsui et al., which application is the National Stage of PCT/JP2009/050233 filed Jan. 9, 2009.

(Continued)

*Primary Examiner* — James Goloboy

(74) *Attorney, Agent, or Firm* — Greenblum & Bernstein, P.L.C.

(57) ABSTRACT

A lubricating oil composition comprising a lubricating base oil, and a mixture and/or a reaction product of (A) 0.01-0.5% by mass of at least one compound selected from among acid phosphates represented by formula (1) or formula (2), and (B) 0.01-2% by mass of an alkylamine represented by formula (3), based on the total weight of the composition, wherein the acid value due to component (A) is 0.1-1.0 mgKOH/g. [$R^1$ and $R^2$ represent hydrogen or straight-chain alkyl or straight-chain alkenyl groups, with at least one of $R^1$ and $R^2$ being a C6-12 straight-chain alkyl or straight-chain alkenyl group; $R^3$ and $R^4$ represent hydrogen straight-chain alkyl or straight-chain alkenyl groups, with at least one of $R^3$ and $R^4$ being a C13-18 straight-chain alkyl or straight-chain alkenyl group; and $R^5$ and $R^6$ represent hydrogen or C4-30 branched-chain alkyl groups, with at least one of $R^5$ and $R^6$ being a branched-chain alkyl group.]

[Chemical Formula 1]

(1)

(2)

(3)

2 Claims, 1 Drawing Sheet

(56) References Cited

FOREIGN PATENT DOCUMENTS

| | | | |
|---|---|---|---|
| JP | 2005-187647 | A | 7/2005 |
| JP | 2006-070222 | | 3/2006 |
| JP | 2007-238764 | A | 9/2007 |
| JP | 2008-13688 | A | 1/2008 |
| KR | 1992-0701403 | | 8/1992 |
| KR | 1997-0042972 | | 7/1997 |
| KR | 10-2005-0098956 | | 10/2005 |
| KR | 10-2007-0032293 | | 3/2007 |
| WO | 2006/100188 | A1 | 9/2006 |

OTHER PUBLICATIONS

U.S. Appl. No. 12/865,921 to Kazuaki Hayasaka, which application is the National Stage of PCT/JP2009/051906 filed on Feb. 4, 2009.

U.S. Appl. No. 12/934,374 to Kazuo Tagawa, which application is the National Stage of PCT/JP2009/055667 filed on Mar. 23, 2009.

U.S. Appl. No. 12/934,431 to Kazuo Tagawa et al., which application is the National Stage of PCT/JP2009/055666 filed on Mar. 23, 2009.

U.S. Appl. No. 12/934,472 to Kazuo Tagawa et al., which application is the National Stage of PCT/JP2009/055690 filed on Mar. 23, 2009.

International Search Report for PCT/JP2009/054778, mailed Jun. 16, 2009.

International Preliminary Report on Patentability for PCT/JP2009/054778, mailed Nov. 18, 2010.

Office Action issued with respect to patent family member Japanese Patent Application No. 2008-084307, mailed Oct. 9, 2012.

Korean Notice of Allowance for Korean Patent Application No. 10-2010-7019705, mailed Jul. 9, 2015.

* cited by examiner

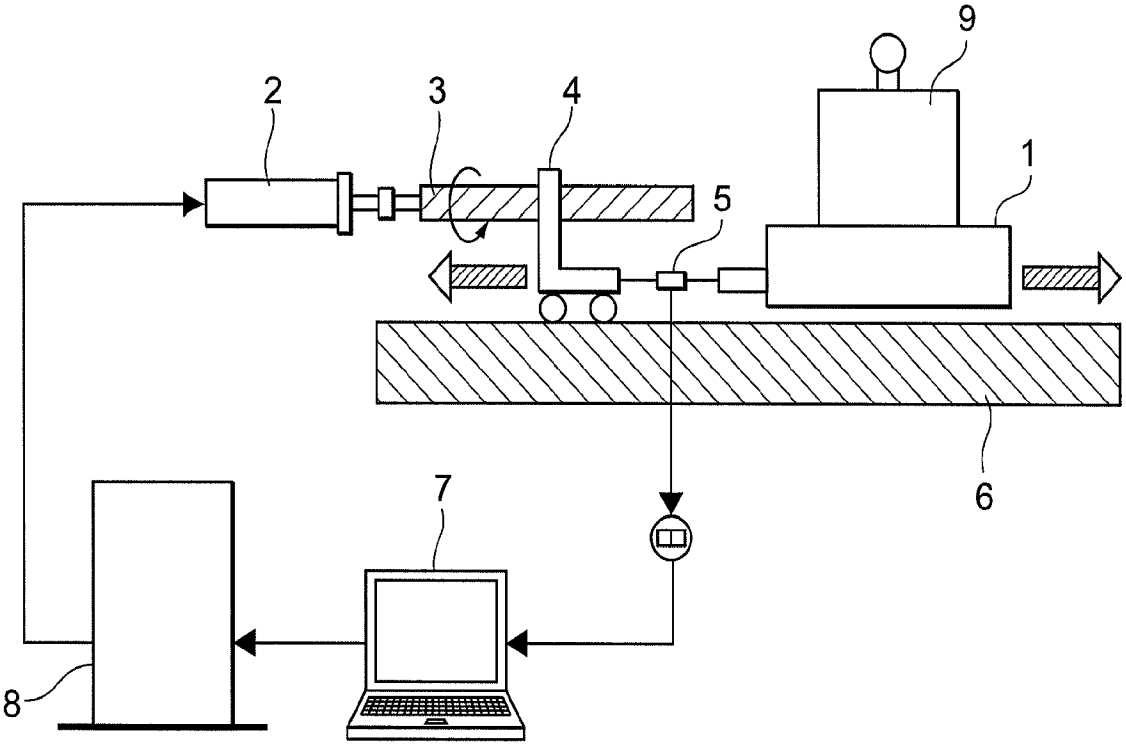
1
2
3
4
5
6
7
8
9

LUBRICANT COMPOSITION

CROSS-REFERENCE TO RELATED APPLICATIONS

The present application is a continuation of U.S. application Ser. No. 12/933,805, which is a National Stage of International Patent Application No. PCT/JP2009/054778 filed Mar. 12, 2009, which claims priority to Japanese Application No. 2008-084307, filed on Mar. 27, 2008, and Japanese Patent Application No. 2008-084377, filed on Mar. 27, 2008. The disclosures of U.S. application Ser. No. 12/933,805 and International Patent Application No. PCT/JP2009/054778 are incorporated by reference herein in their entireties.

TECHNICAL FIELD

The present invention relates to a lubricating oil composition.

BACKGROUND ART

Lubricating oils for sliding guide surfaces such as machine tool work tables must have low friction and anti stick-slip performance to improve machining accuracy, as well as storage stability, corrosion resistance and the like. Most machine tools have a construction in which the lubricating oil for the sliding guide surface is blended with the working fluid for the workpiece. Particularly in cases where a water-soluble cutting fluid is used as the working fluid, blending of the lubricating oil for the sliding guide surface is one cause of deterioration of the water-soluble cutting fluid (reduced cutting performance, accelerated decay, shortened mineral oil life and increased waste water disposal cost). The performance of a sliding guide surface lubricating oil must therefore include an excellent lubrication property, which reduces frictional coefficient and prevents stick-slip on the sliding guide surface, and excellent separability from the water-soluble cutting fluid, since it is blended with the water-soluble cutting fluid, without adversely affecting the performance of the water-soluble cutting fluid or of the lubricating oil for the sliding guide surface.

A variety of extreme-pressure agents or oil agents have been used to date as friction reducers. Demands for accuracy, in particular, of machine tools have been increasing in recent years, and phosphoric acid esters, acid phosphates, carboxylic acids, sulfur compounds, amines and the like have been used to realize reduced friction in the low-speed range, which has an important effect on accuracy (see Patent documents 1, 2, 3 and 4, for example). Also, neutralization of acid phosphates with alkylamines has been attempted to improve stability (see Patent document 5, for example).

[Patent document 1] Japanese Unexamined Patent Application Publication HEI No. 8-134488

[Patent document 2] Japanese Unexamined Patent Application Publication No. 2001-104973

[Patent document 3] Japanese Unexamined Patent Application Publication No. 2003-171684

[Patent document 4] Japanese Unexamined Patent Application Publication No. 2003-430949

[Patent document 5] Japanese Unexamined Patent Application Publication No. 2007-238764

DISCLOSURE OF THE INVENTION

Problems to be Solved by the Invention

In the prior art, however, the environmental burden of additives is high, and although the additives used allow excellent initial friction performance and machine tool positioning performance to be achieved, blending of water-soluble cutting fluids with sliding guide surface lubricating oils significantly inhibits the initial low friction, while also being a cause of poor machining accuracy of machine tools, due to factors such as corrosion of iron-containing sliding surfaces by acidic components such as phosphoric acid, and continued use of such devices tends to result in poorer positioning accuracy.

It has been attempted in the past to improve stability by neutralizing acid phosphates with alkylamines, but it has been difficult to continuously maintain low friction for prolonged periods with combinations of additives in the prior art. A need therefore exists for lubricants that continuously maintain excellent friction performance for prolonged periods.

The present invention has been accomplished in light of these circumstances, and its object is to provide a lubricating oil composition which is excellent in terms of the low-friction property, positioning property, thermal stability and low-temperature storage stability, and that does not have a significantly impaired initial low-friction property even when cutting fluids are blended therewith, as well as to provide a lubricating oil composition that also exhibits excellent corrosion resistance.

Means for Solving the Problems

As a result of much diligent research directed toward achieving the object stated above, the present inventors have discovered that the aforementioned problems can be solved by a lubricating oil composition comprising a mixture and/or a reaction product of a specific acidic phosphoric acid ester and a specific aliphatic amine in a specific proportion in a lubricating base oil, wherein the acid value due to the acidic phosphoric acid ester satisfies specific conditions, and the invention has been completed upon this discovery.

Specifically, the lubricating oil composition of the invention comprises a lubricating base oil, and a mixture and/or a reaction product of (A) 0.01-0.5% by mass of at least one compound selected from among acid phosphates represented by the following formula (1) or the following formula (2), and (B) 0.01-2% by mass of an alkylamine represented by the following formula (3), based on the total weight of the composition, the acid value due to component (A) being 0.1-1.0 mgKOH/g.

[Chemical Formula 1]

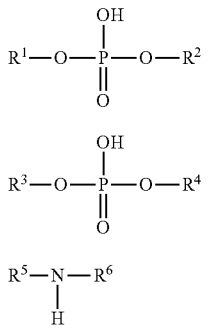

(1)

(2)

(3)

wherein $R^1$ and $R^2$ may be the same or different, and each represents hydrogen or a straight-chain alkyl or straight-chain alkenyl group, with at least one of $R^1$ and $R^2$ being a C6-12 straight-chain alkyl or straight-chain alkenyl group;

wherein $R^3$ and $R^4$ may be the same or different, and each represents hydrogen or a straight-chain alkyl or straight-chain alkenyl group, with at least one of $R^3$ and $R^4$ being a C13-18 straight-chain alkyl or straight-chain alkenyl group; and wherein $R^5$ and $R^6$ may be the same or different, and each represents hydrogen or a C4-30 branched-chain alkyl group, with at least one of $R^5$ and $R^6$ being a branched-chain alkyl group.

In the lubricating oil composition of the invention, the lubricating oil is preferably a lubricating base oil with a viscosity index of 105 or greater, a saturated hydrocarbon component of 70% by mass or greater and a sulfur content of not greater than 0.2% by mass.

Also, the nitrogen content of the lubricating base oil is preferably not greater than 10 ppm by mass and the flash point of the lubricating base oil is preferably 250° C. or higher.

The lubricating oil composition of the invention preferably further comprises (C) 0.01-5% by mass of a sulfur compound, based on the total weight of the composition.

The lubricating oil composition of the invention may be used for various purposes, but it is preferably used in a machine tool, and most preferably on a machine tool sliding guide surface.

Effect of the Invention

The lubricating oil composition of the invention is excellent in terms of low-friction property, positioning property, thermal stability and low-temperature storage stability, does not notably impair the initial low-friction property even when a cutting fluid is blended therewith, can maintain machining accuracy, and also exhibits excellent corrosion resistance. The lubricating oil composition of the invention is therefore highly useful from the viewpoint of stabilization of machine tool operation, and prolongation of usable life.

BRIEF DESCRIPTION OF THE DRAWINGS

FIG. 1 is a general schematic drawing showing the frictional coefficient measuring system used for the examples.

EXPLANATION OF SYMBOLS

1: Table, 2: A/C servomotor, 3: feed screw, 4: movable jig, 5: load cell, 6: bed, 7: computer, 8: control panel, 9: weight.

BEST MODES FOR CARRYING OUT THE INVENTION

Preferred embodiments of the invention will now be described in detail.

There are no particular restrictions on the method of producing the mineral base oil for use according to the invention, and for example, it may be a paraffin-based or naphthene-based mineral oil obtained by applying an appropriate combination of one or more refining means such as solvent deasphalting, solvent extraction, hydrocracking, solvent dewaxing, catalytic dewaxing, hydrorefining, sulfuric acid washing or white clay treatment, on a lube-oil distillate obtained from atmospheric distillation and vacuum distillation of crude oil. A fat or oil and/or synthetic oil may also be added to the lubricating base oil of the invention.

The fat or oil may be beef tallow, lard, soybean oil, rapeseed oil, rice bran oil, coconut oil, palm oil, palm kernel oil, or hydrogenated forms of the foregoing.

Examples of synthetic oils include poly-α-olefins (ethylene-propylene copolymer, polybutene, 1-octene oligomer, 1-decene oligomer, and hydrides thereof), as well as synthetic hydrocarbon oils such as alkylbenzenes and alkylnaphthalenes. The methods for producing these are not particularly restricted, and may be any methods commonly employed for production.

Examples of synthetic oils other than the aforementioned synthetic hydrocarbon oils include monoesters (butyl stearate, octyl laurate and the like), diesters (ditridecyl glutarate, di-2-ethylhexyl adipate, diisodecyl adipate, ditridecyl adipate, di-2-ethylhexyl sebacate and the like), polyesters (trimellitic acid ester and the like), polyol esters (trimethylolpropane caprylate, trimethylolpropane pelargonate, pentaerythritol-2-ethyl hexanoate, pentaerythritol pelargonate and the like), polyoxyalkylene glycols, polyphenyl ethers, dialkyldiphenyl ethers, phosphoric acid esters (tricresyl phosphate and the like), fluorinated compounds (perfluoropolyethers, fluorinated polyolefins and the like), and silicone oils.

The lubricating base oil of the invention may contain one or a combination of two or more of these fats or oils and/or synthetic oils.

There are no particular restrictions on the viscosity of the lubricating base oil used for the invention, but the kinematic viscosity at 40° C. is preferably in the range of 10-700 $mm^2/s$ and more preferably in the range of 15-500 $mm^2/s$. The lubricating base oil content is also not particularly restricted but is preferably in the range of 50-99.98% by mass based on the total weight of the composition.

A preferred example of a lubricating base oil to be used for the invention is a lubricating base oil with a viscosity index of 105 or greater, a saturated hydrocarbon component of 70% by mass or greater and a sulfur content of not greater than 0.2% by mass (hereinafter referred to as "lubricating base oil of the invention"). The lubricating base oil of the invention will now be described in detail.

The lubricating base oil of the invention is not particularly restricted so long as the viscosity index, saturated hydrocarbon component and sulfur content satisfy the aforementioned conditions, but it is preferably a lubricating base oil prepared by hydrocracking/hydroisomerization of a mineral oil or a normal paraffin-containing stock oil (hereinafter also referred to as "wax isomerized base oil"), a synthetic hydrocarbon oil or a mixture of two or more selected from among them, having a viscosity index of 105 or greater, a saturated hydrocarbon component of 70% by mass or greater and a sulfur content of not greater than 0.2% by mass.

If the viscosity index of the lubricating base oil is 105 or greater it will be possible to obtain a lubricating oil composition that can more satisfactorily exhibit both oil film formability and fluid resistance lowering performance. If the saturated hydrocarbon component is less than 70% by mass, the oxidation stability will be notably lowered and sludge will tend to be generated. If the sulfur content exceeds 0.2, the thermal stability will be impaired and the frictional coefficient will be more adversely affected.

The viscosity index for the purpose of the invention is the viscosity index measured according to JIS K 2283-1993. The saturated hydrocarbon component content is the value measured according to ASTM D 2007-93 (units: % by mass).

The nitrogen content of the lubricating base oil of the invention is preferably not greater than 10 ppm by mass. If the nitrogen content exceeds 10 ppm by mass, the oxidation stability or thermal stability will tend to be reduced. The nitrogen content for the purpose of the invention is the nitrogen content measured according to JIS K 2609-1990.

The flash point of the lubricating base oil of the invention is preferably 250° C. or higher. An oil with a flash point of 250°

C. or higher does not qualify as a "flammable liquid" within the definition of a Type 4 hazardous material under the Japan Fire Service Law, and is classified as a designated "combustible liquid", the storage and handling of which is much less restricted than a Type 4 hazardous material. The flash point for the purpose of the invention is the flash point measured according to JIS K 2265.

The lubricating oil composition of the invention may also contain base oils other than the lubricating base oil of the invention, such as fats or oils and/or synthetic oils other than those of the invention.

A wax isomerized base oil to be used for the invention is a lubricating base oil prepared by hydrocracking/hydroisomerization of a normal paraffin-containing stock oil, described below.

An example of a preferred embodiment of the method for production of a wax isomerized base oil of the invention is a method for production of a wax isomerized base oil comprising a step of hydrocracking/hydroisomerization of a stock oil containing normal paraffins, until the urea adduct value of the obtained treatment product is not greater than 4% by mass, the viscosity index is 130 or higher and the NOACK evaporation is not greater than 15% by mass.

The urea adduct value according to the invention is measured by the following method. A 100 g weighed portion of sample oil (wax isomerized base oil) is placed in a round bottom flask, 200 g of urea, 360 ml of toluene and 40 ml of methanol are added and the mixture is stirred at room temperature for 6 hours. This produces white particulate crystals as urea adduct in the reaction mixture. The reaction mixture is filtered with a 1 micron filter to obtain the produced white particulate crystals, and the crystals are washed 6 times with 50 ml of toluene. The recovered white crystals are placed in a flask, 300 ml of purified water and 300 ml of toluene are added and the mixture is stirred at 80° C. for 1 hour. The aqueous phase is separated and removed with a separatory funnel, and the toluene phase is washed 3 times with 300 ml of purified water. After dewatering treatment of the toluene phase by addition of a desiccant (sodium sulfate), the toluene is distilled off. The proportion (weight percentage) of urea adduct obtained in this manner with respect to the sample oil is defined as the urea adduct value.

The NOACK evaporation for the purpose of the invention is the evaporation loss as measured according to ASTM D 5800-95.

Another preferred embodiment of the method for production of a lubricating base oil of the invention is a method for production of a wax isomerized base oil comprising a step of hydrocracking/hydroisomerization of a normal paraffin-containing stock oil, until the urea adduct value of the obtained treatment product is not greater than 4% by mass, the viscosity index is 130 or higher, the CCS viscosity at −35° C. is not greater than 2000 mPa·s, and the product of the kinematic viscosity at 40° C. (units: $mm^2/s$) and the NOACK evaporation (units: % by mass) is not greater than 250.

In the process for production of a wax isomerized base oil according to the invention, it is preferred for the stock oil to contain at least 50% by mass slack wax obtained by solvent dewaxing of the wax isomerized base oil.

Also, from the viewpoint of improving the low-temperature viscosity characteristic without impairing the viscosity-temperature characteristic, the urea adduct value of the wax isomerized base oil of the invention must be not greater than 4% by mass as mentioned above, and it is preferably not greater than 3.5% by mass, more preferably not greater than 3% by mass and even more preferably not greater than 2.5% by mass. The urea adduct value of the wax isomerized base oil may even be 0% by mass. However, it is preferably 0.1% by mass or greater, more preferably 0.5% by mass or greater and most preferably 0.8% by mass or greater, from the viewpoint of obtaining a wax isomerized base oil with a sufficient low-temperature viscosity characteristic and a higher viscosity index, and also of relaxing the dewaxing conditions for increased economy.

From the viewpoint of improving the viscosity-temperature characteristic, the viscosity index of the wax isomerized base oil of the invention must be 105 or greater as mentioned above, and it is preferably 110 or greater, more preferably 120 or greater, even more preferably 130 or greater and most preferably 140 or greater.

The stock oil used for production of the wax isomerized base oil of the invention may include normal paraffins or normal paraffin-containing wax. The stock oil may be a mineral oil or a synthetic oil, or a mixture of two or more thereof.

The stock oil used for the invention preferably is a wax-containing starting material that boils in the range of lubricating oils according to ASTM D86 or ASTM D2887. The wax content of the stock oil is preferably between 50% by mass and 100% by mass based on the total weight of the stock oil. The wax content of the starting material can be measured by a method of analysis such as nuclear magnetic resonance spectroscopy (ASTM D5292), n-d-M method (ASTM D3238) or the solvent method (ASTM D3235).

As examples of wax-containing starting materials there may be mentioned oils derived from solvent refining methods, such as raffinates, partial solvent dewaxed oils, deasphalted oils, distillates, vacuum gas oils, coker gas oils, slack waxes, foot oil, Fischer-Tropsch waxes and the like, among which slack waxes and Fischer-Tropsch waxes are preferred.

Slack wax is typically derived from hydrocarbon starting materials by solvent or propane dewaxing. Slack waxes may contain residual oil. The residual oil can be removed by deoiling. Foot oil corresponds to deoiled slack wax.

Fischer-Tropsch waxes are produced by so-called Fischer-Tropsch synthesis.

Commercial normal paraffin-containing stock oils are also available. Specifically, there may be mentioned Paraflint 80 (hydrogenated Fischer-Tropsch wax) and Shell MDS Waxy Raffinate (hydrogenated and partially isomerized heart cut distilled synthetic wax raffinate).

Stock oil from solvent extraction is obtained by feeding a high boiling point petroleum fraction from atmospheric distillation to a vacuum distillation apparatus and subjecting the distillation fraction to solvent extraction. The residue from vacuum distillation may also be deasphalted. In solvent extraction methods, the aromatic components are dissolved in the extract phase while leaving more paraffinic components in the raffinate phase. Naphthenes are distributed in the extract phase and raffinate phase. The preferred solvents for solvent extraction are phenols, furfurals and N-methylpyrrolidone. By controlling the solvent/oil ratio, extraction temperature and method of contacting the solvent with the distillate to be extracted, it is possible to control the degree of separation between the extract phase and raffinate phase. There may also be used as the starting material a bottom fraction obtained from a fuel oil hydrocracker, using a fuel oil hydrocracker with higher hydrocracking performance.

The wax isomerized base oil of the invention may be obtained through a step of hydrocracking/hydroisomerization of the stock oil until the treatment product has a urea adduct value of not greater than 4% by mass and a viscosity index of 100 or higher. The hydrocracking/hydroisomerization step is not particularly restricted so long as it satisfies the aforementioned conditions for the urea adduct value and viscosity index of the treatment product. A preferred hydrocracking/hydroisomerization step according to the invention comprises:

a first step in which a normal paraffin-containing stock oil is subjected to hydrotreatment using a hydrotreatment catalyst, a second step in which the treatment product from the first step is subjected to hydrodewaxing using a hydrodewaxing catalyst, and a third step in which the treatment product from the second step is subjected to hydrorefining using a hydrorefining catalyst.

Conventional hydrocracking/hydroisomerization also includes a hydrotreatment step in an early stage of the hydrodewaxing step, for the purpose of desulfurization and denitrification to prevent poisoning of the hydrodewaxing catalyst. In contrast, the first step (hydrotreatment step) according to the invention is carried out to decompose a portion (for example, about 10% by mass and preferably 1-10% by mass) of the normal paraffins in the stock oil at an early stage of the second step (hydrodewaxing step), thus allowing desulfurization and denitrification in the first step as well, although the purpose differs from that of conventional hydrotreatment. The first step is preferred in order to reliably limit the urea adduct value of the treatment product obtained after the third step (the wax isomerized base oil) to not greater than 4% by mass.

As hydrogenation catalysts to be used in the first step there may be mentioned catalysts containing Group 6 metals and Group 8-10 metals, as well as mixtures thereof. As preferred metals there may be mentioned nickel, tungsten, molybdenum and cobalt, and mixtures thereof. The hydrogenation catalyst may be used in a form with the aforementioned metals supported on a heat-resistant metal oxide carrier, and normally the metal will be present on the carrier as an oxide or sulfide. When a mixture of metals is used, it may be used as a bulk metal catalyst with an amount of metal of at least 30% by mass based on the total weight of the catalyst. The metal oxide carrier may be an oxide such as silica, alumina, silica-alumina or titania, with alumina being preferred. Preferred alumina is $\gamma$ or $\beta$ porous alumina. The loading weight of the metal is preferably 0.5-35% by mass based on the total weight of the catalyst. When a mixture of a metal of Groups 9-10 and a metal of Group 6 is used, preferably the metal of Group 9 or 10 is present in an amount of 0.1-5% by mass and the metal of Group 6 is present in an amount of 5-30% by mass based on the total weight of the catalyst. The loading weight of the metal may be measured by atomic absorption spectrophotometry or inductively coupled plasma emission spectroscopy, or the individual metals may be measured by other ASTM methods.

The acidity of the metal oxide carrier can be controlled by controlling the addition of additives and the nature of the metal oxide carrier (for example, controlling the amount of silica incorporated in a silica-alumina carrier). As examples of additives there may be mentioned halogens, especially fluorine, and phosphorus, boron, yttria, alkali metals, alkaline earth metals, rare earth oxides and magnesia. Co-catalysts such as halogens generally raise the acidity of metal oxide carriers, while weakly basic additives such as yttria and magnesia can be used to lower the acidity of the carrier.

As regards the hydrotreatment conditions, the treatment temperature is preferably 150-450° C. and more preferably 200-400° C., the hydrogen partial pressure is preferably 1400-20,000 kPa and more preferably 2800-14,000 kPa, the liquid hourly space velocity (LHSV) is preferably 0.1-10 $hr^{-1}$ and more preferably 0.1-5 $hr^{-1}$, and the hydrogen/oil ratio is preferably 50-1780 $m^3/m^3$ and more preferably 89-890 $m^3/m^3$. These conditions are only for example, and the hydrotreatment conditions in the first step may be appropriately selected for different starting materials, catalysts and apparatuses, in order to obtain the specified urea adduct value and viscosity index for the treatment product obtained after the third step.

The treatment product obtained by hydrotreatment in the first step may be directly supplied to the second step, but a step of stripping or distillation of the treatment product and separating removal of the gas product from the treatment product (liquid product) is preferably conducted between the first step and second step. This can reduce the nitrogen and sulfur contents in the treatment product to levels that will not affect prolonged use of the hydrodewaxing catalyst in the second step. The main objects of separating removal by stripping and the like are gaseous contaminants such as hydrogen sulfide and ammonia, and stripping can be accomplished by ordinary means such as a flash drum, distiller or the like.

When the hydrotreatment conditions in the first step are mild, residual polycyclic aromatic components can potentially remain depending on the starting material used, and such contaminants may be removed by hydrorefining in the third step.

The hydrodewaxing catalyst used in the second step may contain crystalline or amorphous materials. Examples of crystalline materials include molecular sieves having 10- or 12-membered ring channels, composed mainly of aluminosilicates (zeolite) or silicoaluminophosphates (SAPO). Specific examples of zeolites include ZSM-22, ZSM-23, ZSM-35, ZSM-48, ZSM-57, ferrierite, ITQ-13, MCM-68, MCM-71 and the like. ECR-42 may be mentioned as an example of an aluminophosphate. Examples of molecular sieves include zeolite beta and MCM-68. Among the above there are preferably used one or more selected from among ZSM-48, ZSM-22 and ZSM-23, with ZSM-48 being particularly preferred. The molecular sieves are preferably hydrogen-type. Reduction of the hydrodewaxing catalyst may occur at the time of hydrodewaxing. Alternatively, a hydrodewaxing catalyst that has been previously subjected to reduction treatment may be used for the hydrodewaxing.

As amorphous materials for the hydrodewaxing catalyst there may be mentioned alumina doped with Group 3 metals, fluorinated alumina, silica-alumina, fluorinated silica-alumina, silica-alumina and the like.

A preferred mode of the dewaxing catalyst is a bifunctional catalyst, i.e. one carrying a metal hydrogenated component which is at least one metal of Group 6, at least one metal of Groups 8-10 or a mixture thereof. Preferred metals are precious metals of Groups 9-10, such as Pt, Pd or mixtures thereof. Such metals are supported at preferably 0.1-30% by mass based on the total weight of the catalyst. The method for preparation of the catalyst and loading of the metal may be, for example, an ion-exchange method or impregnation method using a decomposable metal salt.

When molecular sieves are used, they may be compounded with a binder material that is heat resistant under the hydrodewaxing conditions, or they may be binderless (self-binding). As binder materials there may be mentioned inorganic oxides, including silica, alumina, silica-alumina, two-component combinations of silica with other metal oxides such as titania, magnesia, yttria and zirconia, and three-component combinations of oxides such as silica-alumina-yttria, silica-alumina-magnesia and the like. The amount of molecular sieves in the hydrodewaxing catalyst is preferably 10-100% by mass and more preferably 35-100% by mass based on the total weight of the catalyst. The hydrodewaxing catalyst may be formed by a method such as spray-drying or extrusion. The hydrodewaxing catalyst may be used in sulfided or non-sulfided form, although a sulfided form is preferred.

As regards the hydrodewaxing conditions, the temperature is preferably 250-400° C. and more preferably 275-350° C., the hydrogen partial pressure is preferably 791-20,786 kPa (100-3000 psig) and more preferably 1480-17,339 kPa (200-2500 psig), the liquid hourly space velocity is preferably 0.1-10 $hr^{-1}$ and more preferably 0.1-5 $hr^{-1}$, and the hydrogen/oil ratio is preferably 45-1780 $m^3/m^3$ (250-10,000 scf/B) and more preferably 89-890 $m^3/m^3$ (500-5000 scf/B). These conditions are only for example, and the hydrodewaxing conditions in the second step may be appropriately selected for different starting materials, catalysts and apparatuses, in order to obtain the specified urea adduct value and viscosity index for the treatment product obtained after the third step.

The treatment product that has been hydrodewaxed in the second step is then supplied to hydrorefining in the third step. Hydrorefining is a form of mild hydrotreatment aimed at removing residual heteroatoms and color components while also saturating the olefins and residual aromatic compounds by hydrogenation. The hydrorefining in the third step may be carried out in a cascade fashion with the dewaxing step.

The hydrorefining catalyst used in the third step is preferably one comprising a Group 6 metal, a Group 8-10 metal or a mixture thereof supported on a metal oxide support. As preferred metals there may be mentioned precious metals, and especially platinum, palladium and mixtures thereof. When a mixture of metals is used, it may be used as a bulk metal catalyst with an amount of metal of 30% by mass or greater based on the weight of the catalyst. The metal content of the catalyst is preferably not greater than 20% by mass non-precious metals and preferably not greater than 1% by mass precious metals. The metal oxide support may be either an amorphous or crystalline oxide. Specifically, there may be mentioned low acidic oxides such as silica, alumina, silica-alumina and titania, with alumina being preferred. From the viewpoint of saturation of aromatic compounds, it is preferred to use a hydrorefining catalyst comprising a metal with a relatively powerful hydrogenating function supported on a porous carrier.

As preferred hydrorefining catalysts there may be mentioned meso-microporous materials belonging to the M41S class or line of catalysts. M41S line catalysts are meso-microporous materials with high silica contents, and specific ones include MCM-41, MCM-48 and MCM-50. The hydrorefining catalyst has a pore size of 15-100 Å, and MCM-41 is particularly preferred. MCM-41 is an inorganic porous non-laminar phase with a hexagonal configuration and pores of uniform size. The physical structure of MCM-41 manifests as straw-like bundles with straw openings (pore cell diameters) in the range of 15-100 angstroms. MCM-48 has cubic symmetry, while MCM-50 has a laminar structure. MCM-41 may also have a structure with pore openings having different meso-microporous ranges. The meso-microporous material may contain metal hydrogenated components consisting of one or more Group 8, 9 or 10 metals, and preferred as metal hydrogenated components are precious metals, especially Group 10 precious metals, and most preferably Pt, Pd or their mixtures.

As regards the hydrorefining conditions, the temperature is preferably 150-350° C. and more preferably 180-250° C., the total pressure is preferably 2859-20,786 kPa (approximately 400-3000 psig), the liquid hourly space velocity is preferably 0.1-5 $hr^{-1}$ and more preferably 0.5-3 $hr^{-1}$, and the hydrogen/oil ratio is preferably 44.5-1780 $m^3/m^3$ (250-10,000 scf/B). These conditions are only for example, and the hydrorefining conditions in the third step may be appropriately selected for different starting materials and treatment apparatuses, so that the urea adduct value and viscosity index for the treatment product obtained after the third step satisfy the respective conditions specified above.

The treatment product obtained after the third step may be subjected to distillation or the like as necessary for separating removal of certain components.

The wax isomerized base oil of the invention obtained by the production method described above is not restricted in terms of its other properties so long as the urea adduct value and viscosity index satisfy their respective conditions. The wax isomerized base oil of the invention preferably also satisfies the conditions specified below.

The saturated component content of the wax isomerized base oil of the invention is 70% by mass or greater, preferably 90% by mass or greater, more preferably 93% by mass or greater and even more preferably 95% by mass or greater, based on the total weight of the wax isomerized base oil. The proportion of cyclic saturated components among the saturated components is preferably 0.1-50% by mass, more preferably 0.5-40% by mass, even more preferably 1-30% by mass and most preferably 5-20% by mass. If the saturated component content and proportion of cyclic saturated components among the saturated components both satisfy these respective conditions, it will be possible to achieve adequate levels for the viscosity-temperature characteristic and heat and oxidation stability, while additives added to the wax isomerized base oil will be kept in a sufficiently stable dissolved state in the wax isomerized base oil, and it will be possible for the functions of the additives to be exhibited at a higher level. In addition, a saturated component content and proportion of cyclic saturated components among the saturated components satisfying the aforementioned conditions can improve the frictional properties of the wax isomerized base oil itself, resulting in a greater friction reducing effect and thus increased energy savings.

If the saturated component content is less than 70% by mass, the viscosity-temperature characteristic, heat and oxidation stability and frictional properties will tend to be inadequate. If the proportion of cyclic saturated components among the saturated components is less than 0.1% by mass, the solubility of the additives included in the wax isomerized base oil will be insufficient and the effective amount of additives kept dissolved in the wax isomerized base oil will be reduced, making it impossible to effectively achieve the function of the additives. If the proportion of cyclic saturated components among the saturated components is greater than 50% by mass, the efficacy of additives included in the wax isomerized base oil will tend to be reduced.

According to the invention, a proportion of 0.1-50% by mass cyclic saturated components among the saturated components is equivalent to 99.9-50% by mass acyclic saturated components among the saturated components. Both normal paraffins and isoparaffins are included by the term "acyclic saturated components". The proportions of normal paraffins and isoparaffins in the wax isomerized base oil of the invention are not particularly restricted so long as the urea adduct value satisfies the condition specified above. The proportion of isoparaffins is preferably 50-99.9% by mass, more preferably 60-99.9% by mass, even more preferably 70-99.9% by mass and most preferably 80-99.9% by mass based on the total weight of the wax isomerized base oil. If the proportion of isoparaffins in the wax isomerized base oil satisfies the aforementioned conditions it will be possible to further improve the viscosity-temperature characteristic and heat and oxidation stability, while additives added to the wax isomerized base oil will be kept in a sufficiently stable dissolved state in the lubricating base oil and it will be possible for the functions of the additives to be exhibited at an even higher level.

The saturated component content for the purpose of the invention is the value measured according to ASTM D 2007-93 (units: % by mass).

The proportions of the cyclic saturated components and acyclic saturated components among the saturated components for the purpose of the invention are the naphthene portion (measured: monocyclic-hexacyclic naphthenes, units: % by mass) and alkane portion (units: % by mass), respectively, both measured according to ASTM D 2786-91.

The proportion of normal paraffins in the wax isomerized base oil for the purpose of the invention is the value obtained by analyzing saturated components separated and fractionated by the method of ASTM D 2007-93 by gas chromatography under the following conditions, and calculating the value obtained by identifying and quantifying the proportion of normal paraffins among those saturated components, with respect to the total weight of the wax isomerized base oil. For identification and quantitation, a C5-50 straight-chain normal paraffin mixture sample is used as the reference sample, and the normal paraffin content among the saturated components is determined as the proportion of the total of the peak areas corresponding to each normal paraffin, with respect to the total peak area of the chromatogram (subtracting the peak area for the diluent).

(Gas Chromatography Conditions)

Column: Liquid phase nonpolar column (length: 25 cm, inner diameter: 0.3 mmϕ, liquid phase film thickness: 0.1 μm), temperature elevating conditions: 50° C.-400° C. (temperature-elevating rate: 10° C./min).

Carrier gas: helium (linear speed: 40 cm/min)

Split ratio: 90/1

Sample injection rate: 0.5 μL (injection rate of sample diluted 20-fold with carbon disulfide).

The proportion of isoparaffins in the wax isomerized base oil is the value of the difference between the acyclic saturated components among the saturated components and the normal paraffins among the saturated components, based on the total weight of the wax isomerized base oil.

Other methods may be used for separation of the saturated components or for compositional analysis of the cyclic saturated components and acyclic saturated components, so long as they provide similar results. Examples of other methods include the method according to ASTM D 2425-93, the method according to ASTM D 2549-91, methods of high performance liquid chromatography (HPLC), and modified forms of these methods.

When the bottom fraction obtained from a fuel oil hydrocracker is used as the starting material for the wax isomerized base oil of the invention, the obtained base oil will have a saturated component content of 90% by mass or greater, a proportion of cyclic saturated components in the saturated components of 30-50% by mass, a proportion of acyclic saturated components in the saturated components of 50-70% by mass, a proportion of isoparaffins in the wax isomerized base oil of 40-70% by mass and a viscosity index of 100-135 and preferably 120-130. When the urea adduct value satisfies the conditions specified above it will be possible to obtain a wax isomerized composition with the effect of the invention, i.e. an excellent low-temperature viscosity characteristic wherein the −40° C. MR viscosity is not greater than 20,000 mPa·s and especially not greater than 10,000 mPa·s. When a slack wax or Fischer-Tropsch wax having a high wax content (for example, a normal paraffin content of 50% by mass or greater) is used as the starting material for the wax isomerized base oil of the invention, the obtained base oil will have a saturated component content of 90% by mass or greater, a proportion of cyclic saturated components in the saturated components of 0.1-40% by mass, a proportion of acyclic saturated components in the saturated components of 60-99.9% by mass, a proportion of isoparaffins in the wax isomerized base oil of 60-99.9% by mass and a viscosity index of 100-170 and preferably 135-160. When the urea adduct value satisfies the conditions specified above it will be possible to obtain a wax isomerized composition with very excellent properties in terms of the effect of the invention, and especially the high viscosity index and low-temperature viscosity characteristic, wherein the −40° C. MR viscosity is not greater than 12,000 mPa·s and especially not greater than 7000 mPa·s.

If the 20° C. refractive index is represented as $n_{20}$ and the 100° C. kinematic viscosity is represented as kv100, the value of $n_{20}-0.002\times kv100$ for the wax isomerized base oil of the invention is preferably 1.435-1.450, more preferably 1.440-1.449, even more preferably 1.442-1.448 and yet more preferably 1.444-1.447. If $n_{20}-0.002\times kv100$ is within the range specified above it will be possible to achieve an excellent viscosity-temperature characteristic and excellent heat and oxidation stability, while additives added to the wax isomerized base oil will be kept in a sufficiently stable dissolved state in the wax isomerized base oil so that the functions of the additives can be exhibited at an even higher level. A $n_{20}-0.002\times kv100$ value within the aforementioned range can also improve the frictional properties of the wax isomerized base oil itself, resulting in a greater friction reducing effect and thus increased energy savings.

If the $n_{20}-0.002\times kv100$ value exceeds the aforementioned upper limit, the viscosity-temperature characteristic, heat and oxidation stability and frictional properties will tend to be insufficient, and the efficacy of additives when added to the wax isomerized base oil will tend to be reduced. If the $n_{20}-0.002\times kv100$ value is less than the aforementioned lower limit, the solubility of the additives included in the wax isomerized base oil will be insufficient and the effective amount of additives kept dissolved in the wax isomerized base oil will be reduced, tending to interfere with effective function of the additives.

The 20° C. refractive index ($n_{20}$) for the purpose of the invention is the refractive index measured at 20° C. according to ASTM D1218-92. The 100° C. kinematic viscosity (kv100) for the purpose of the invention is the kinematic viscosity measured at 100° C. according to JIS K 2283-1993.

The aromatic content of the wax isomerized base oil of the invention is preferably not greater than 5% by mass, more preferably 0.05-3% by mass, even more preferably 0.1-1% by mass and most preferably 0.1-0.5% by mass based on the total weight of the wax isomerized base oil. If the aromatic content exceeds the aforementioned upper limit, the viscosity-temperature characteristic, heat and oxidation stability, frictional properties, resistance to volatilization and low-temperature viscosity characteristic will tend to be reduced, while the efficacy of additives when added to the wax isomerized base oil will also tend to be reduced. The wax isomerized base oil of the invention may be free of aromatic components. The solubility of additives can be further increased with an aromatic content of 0.05% by mass or greater.

The aromatic content in this case is the value measured according to ASTM D 2007-93. The aromatic portion normally includes alkylbenzenes and alkylnaphthalenes, as well as anthracene, phenanthrene and their alkylated forms, compounds with four or more fused benzene rings, and heteroatom-containing aromatic compounds such as pyridines, quinolines, phenols, naphthols and the like.

The % $C_p$ of the wax isomerized base oil of the invention is preferably 80 or greater, more preferably 82-99, even more preferably 85-98 and most preferably 90-97. If the % $C_p$ value of the wax isomerized base oil is less than 80, the viscosity-temperature characteristic, heat and oxidation stability and frictional properties will tend to be reduced, while the efficacy of additives when added to the wax isomerized base oil will also tend to be reduced. If the % $C_p$ value of the wax isomerized base oil is greater than 99, on the other hand, the additive solubility will tend to be lower.

The % $C_N$ of the wax isomerized base oil of the invention is preferably not greater than 20, more preferably not greater than 15, even more preferably 1-12 and most preferably 3-10. If the % $C_N$ value of the wax isomerized base oil exceeds 20, the viscosity-temperature characteristic, heat and oxidation stability and frictional properties will tend to be reduced. If the % $C_N$ is less than 1, however, the additive solubility will tend to be lower.

The % $C_A$ of the wax isomerized base oil of the invention is preferably not greater than 0.7, more preferably not greater than 0.6 and even more preferably 0.1-0.5. If the % $C_A$ value of the wax isomerized base oil exceeds 0.7, the viscosity-temperature characteristic, heat and oxidation stability and frictional properties will tend to be reduced. The % $C_A$ value of the wax isomerized base oil of the invention may be zero. The solubility of additives can be further increased with a % $C_A$ value of 0.1 or greater.

The ratio of the % $C_P$ and % $C_N$ values for the wax isomerized base oil of the invention is % $C_P$/% $C_N$ of preferably 7 or greater, more preferably 7.5 or greater and even more preferably 8 or greater. If the % $C_P$/% $C_N$ ratio is less than 7, the viscosity-temperature characteristic, heat and oxidation stability and frictional properties will tend to be reduced, while the efficacy of additives when added to the wax isomerized base oil will also tend to be reduced. The % $C_P$/% $C_N$ ratio is preferably not greater than 200, more preferably not greater than 100, even more preferably not greater than 50 and most preferably not greater than 25. The additive solubility can be further increased if the % $C_P$/% $C_N$ ratio is not greater than 200.

The % $C_P$, % $C_N$ and % $C_A$ values for the purpose of the invention are, respectively, the percentage of paraffinic carbons with respect to total carbon atoms, the percentage of naphthenic carbons with respect to total carbons and the percentage of aromatic carbons with respect to total carbons, as determined by the method of ASTM D 3238-85 (n-d-M method). That is, the preferred ranges for % $C_P$, % $C_N$ and % $C_A$ are based on values determined by these methods, and for example, % $C_N$ may be a value exceeding 0 according to these methods even if the wax isomerized base oil contains no naphthene portion.

The iodine value of the wax isomerized base oil of the invention is preferably not greater than 0.5, more preferably not greater than 0.3 and even more preferably not greater than 0.15, and although it may be less than 0.01, it is preferably 0.001 or greater and more preferably 0.05 or greater in consideration of achieving a commensurate effect, and in terms of economy. Limiting the iodine value of the wax isomerized base oil to not greater than 0.5 can drastically improve the heat and oxidation stability. The "iodine value" for the purpose of the invention is the iodine value measured by the indicator titration method according to JIS K 0070, "Test methods for acid value, saponification value, ester value, iodine value, hydroxyl value and unsaponifiable matter of chemical products".

The sulfur content in the wax isomerized base oil of the invention will depend on the sulfur content of the starting material. For example, when using a substantially sulfur-free starting material as for synthetic wax components obtained by Fischer-Tropsch reaction, it is possible to obtain a substantially sulfur-free wax isomerized base oil. When using a sulfur-containing starting material, such as slack wax obtained by a wax isomerized base oil refining process or microwax obtained by a wax refining process, the sulfur content of the obtained wax isomerized base oil will normally be 100 ppm by mass or greater. From the viewpoint of further improving the heat and oxidation stability and reducing sulfur, the sulfur content in the wax isomerized base oil of the invention is preferably not greater than 10 ppm by mass, more preferably not greater than 5 ppm by mass and even more preferably not greater than 3 ppm by mass.

From the viewpoint of cost reduction it is preferred to use slack wax or the like as the starting material, in which case the sulfur content of the obtained wax isomerized base oil is preferably not greater than 50 ppm by mass and more preferably not greater than 10 ppm by mass. The sulfur content for the purpose of the invention is the sulfur content measured according to JIS K 2541-1996.

The nitrogen content in the wax isomerized base oil of the invention is not greater than 10 ppm, preferably not greater than 5 ppm by mass, more preferably not greater than 3 ppm by mass and even more preferably not greater than 1 ppm by mass. If the nitrogen content exceeds 10 ppm by mass, the heat and oxidation stability will tend to be reduced. The nitrogen content for the purpose of the invention is the nitrogen content measured according to JIS K 2609-1990.

The kinematic viscosity of the wax isomerized base oil according to the invention, as the 100° C. kinematic viscosity, is preferably 1.5-20 $mm^2/s$ and more preferably 2.0-11 $mm^2/s$. A 100° C. kinematic viscosity of lower than 1.5 $mm^2/s$ for the wax isomerized base oil is not preferred from the standpoint of evaporation loss. If it is attempted to obtain a wax isomerized base oil having a 100° C. kinematic viscosity of greater than 20 $mm^2/s$, the yield will be reduced and it will be difficult to increase the cracking severity even when using a heavy wax as the starting material.

According to the invention, wax isomerized base oils having a 100° C. kinematic viscosity in the following ranges are preferably used after fractionation by distillation or the like. Wax isomerized base oils having a 100° C. kinematic viscosity of 4.5-20 $mm^2/s$, more preferably 4.8-11 $mm^2/s$ and most preferably 5.5-8.0 $mm^2/s$.

The 40° C. kinematic viscosity of the wax isomerized base oil of the invention is preferably 6.0-80 $mm^2/s$ and more preferably 8.0-50 $mm^2/s$. According to the invention, wax isomerized fractions having a 40° C. kinematic viscosity in the following ranges are preferably used after fractionation by distillation or the like.

Wax isomerized base oils having a 40° C. kinematic viscosity of 28-50 $mm^2/s$, more preferably 29-45 $mm^2/s$ and most preferably 30-40 $mm^2/s$.

The wax isomerized base oil, having a urea adduct value and viscosity index satisfying the respective conditions specified above, can exhibit high levels for both the viscosity-temperature characteristic and low-temperature viscosity characteristic compared to a conventional lubricating base oil of the same viscosity grade, and in particular it has an excellent low-temperature viscosity characteristic, and superior heat and oxidation stability, lubricity and resistance to volatilization.

The 15° C. density ($\rho_{15}$) of the wax isomerized base oil of the invention will also depend on the viscosity grade of the wax isomerized base oil. It is preferably not greater than the value of ρ as represented by the following formula (1), i.e., $\rho_{15} \leq \rho$.

$$\rho = 0.0025 \times kv100 + 0.816 \quad (1)$$

[In this equation, kv100 represents the 100° C. kinematic viscosity ($mm^2/s$) of the wax isomerized base oil.]

If $\rho_{15} > \rho$, the viscosity-temperature characteristic, heat and oxidation stability, resistance to volatilization and low-temperature viscosity characteristic of the wax isomerized base oil will tend to be reduced, while the efficacy of additives when added to the lubricating base oil will also tend to be reduced.

The 15° C. density for the purpose of the invention is the density measured at 15° C. according to JIS K 2249-1995.

The aniline point (AP (° C.)) of the wax isomerized base oil of the invention will also depend on the viscosity grade of the wax isomerized base oil. It is preferably greater than or equal to the value of A as represented by the following formula (2), i.e., AP≥A.

$$A = 4.3 \times kv100 + 100 \quad (2)$$

[In this equation, kv100 represents the 100° C. kinematic viscosity ($mm^2/s$) of the wax isomerized base oil.]

If AP<A, the viscosity-temperature characteristic, heat and oxidation stability, resistance to volatilization and low-temperature viscosity characteristic of the wax isomerized base oil will tend to be reduced, while the efficacy of additives when added to the lubricating base oil will also tend to be reduced.

For example, the AP value of the wax isomerized base oil is preferably 125° C. or higher and more preferably 128° C. or higher. The aniline point for the purpose of the invention is the aniline point measured according to JIS K 2256-1985.

The NOACK evaporation of the wax isomerized base oil is preferably 0% by mass or greater and more preferably 1% by mass or greater, and preferably not greater than 6% by mass, more preferably not greater than 5% by mass and even more preferably not greater than 4% by mass. If the NOACK evaporation is below the aforementioned lower limit it will tend to be difficult to improve the low-temperature viscosity characteristic. If the NOACK evaporation is above the respective upper limit, the evaporation loss of the wax isomerized oil will be increased when the wax isomerized base oil is used as a lubricating oil for an internal combustion engine, and catalyst poisoning will be undesirably accelerated as a result.

For the distillation property of the wax isomerized base oil, the initial boiling point (IBP) is preferably 440-480° C., more preferably 430-470° C. and even more preferably 420-460° C. The 10% distillation temperature (T10) is preferably 450-510° C., more preferably 460-500° C. and even more preferably 460-480° C. The 50% running point (T50) is preferably 470-540° C., more preferably 480-530° C. and even more preferably 490-520° C. The 90% running point (T90) is preferably 470-560° C., more preferably 480-550° C. and even more preferably 490-540° C. The final boiling point (FBP) is preferably 505-565° C., more preferably 515-555° C. and even more preferably 525-565° C. T90-T10 is preferably 35-80° C., more preferably 45-70° C. and even more preferably 55-80° C. FBP-IBP is preferably 50-130° C., more preferably 60-120° C. and even more preferably 70-110° C. T10-IBP is preferably 5-65° C., more preferably 10-55° C. and even more preferably 10-45° C. FBP-T90 is preferably 5-60° C., more preferably 5-50° C. and even more preferably 5-40° C.

By setting IBP, T10, T50, T90, FBP, T90-T10, FBP-IBP, T10-IBP and FBP-T90 within the preferred ranges specified above for the wax isomerized base oil, it is possible to further improve the low temperature viscosity and further reduce the evaporation loss. If the distillation ranges for T90-T10, FBP-IBP, T10-IBP and FBP-T90 are too narrow, the wax isomerized base oil yield will be poor resulting in low economy.

The IBP, T10, T50, T90 and FBP values for the purpose of the invention are the running points measured according to ASTM D 2887-97.

Component (A) is, specifically, a compound represented by the following formula (1) or formula (2).

[Chemical Formula 2]

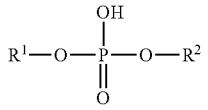

(1)

[In the formulas, $R^1$ and $R^2$ may be the same or different, and each represents hydrogen or a straight-chain alkyl or straight-chain alkenyl group, and at least one of $R^1$ and $R^2$ is a C6-12 straight-chain alkyl or straight-chain alkenyl group.]

[Chemical Formula 3]

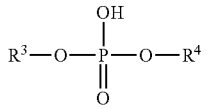

(2)

[In the formulas, $R^3$ and $R^4$ may be the same or different, and each represents hydrogen or a straight-chain alkyl or straight-chain alkenyl group, and at least one of $R^3$ and $R^4$ is a C13-18 straight-chain alkyl or straight-chain alkenyl group.]

The straight-chain alkyl or straight-chain alkenyl groups of $R^1$ and $R^2$ are, specifically, straight-chain hexyl, straight-chain hexenyl, straight-chain heptyl, straight-chain heptenyl, straight-chain octyl, straight-chain octenyl, straight-chain nonyl, straight-chain nonenyl, straight-chain decyl, straight-chain decenyl, straight-chain undecyl, straight-chain undecenyl, straight-chain dodecyl or straight-chain dodecenyl groups, and the alkyl or straight-chain alkenyl groups of $R^3$ and $R^4$ are, specifically, straight-chain tridecyl, straight-chain tridecenyl, straight-chain tetradecyl, straight-chain tetradecenyl, straight-chain pentadecyl, straight-chain pentadecenyl, straight-chain hexadecyl, straight-chain hexadecenyl, straight-chain heptadecyl, straight-chain heptadecenyl, straight-chain octadecyl, straight-chain octadecenyl or oleyl groups.

Component (A) used for the invention includes compounds wherein one of $R^1$ and $R^2$ in formula (1) or one of $R^3$ and $R^4$ in formula (2) is hydrogen while the other is a straight-chain alkyl or straight-chain alkenyl group (phosphoric acid monoesters), and compounds wherein both $R^1$ and $R^2$ or both $R^3$ and $R^4$ are straight-chain alkyl and/or straight-chain alkenyl groups (phosphoric acid diesters). According to the invention, either a phosphoric acid monoester or phosphoric acid diester may be used alone, or a mixture of a phosphoric acid monoester and a phosphoric acid diester may be used, although from the viewpoint of frictional properties it is preferred to use a mixture of a phosphoric acid monoester and a phosphoric acid diester. When a mixture is used, the phosphoric acid monoester/phosphoric acid diester mixing ratio is preferably 10/90-90/10, more preferably 20/80-80/20 and even more preferably 30/70-70/30, as the molar ratio.

The content of component (A) in the lubricating oil composition of the invention will usually be 0.01-0.5% by mass based on the total weight of the composition. From the viewpoint of excellent low-friction performance it is preferably 0.05% by mass or greater and more preferably 0.1% by mass or greater based on the total weight of the composition. From the viewpoint of excellent corrosion resistance of the obtained lubricating oil composition, the content of component (A) is not greater than 0.5% by mass and preferably not greater than 0.4% by mass, based on the total weight of the composition. The content of component (A) as phosphorus element will differ depending on the molecular weight of component (A), but it will usually be 0.0005-0.06% by mass, preferably 0.003-0.06% by mass and most preferably 0.005-0.05 as phosphorus element, based on the total weight of the composition.

The acid value due to component (A) in the lubricating oil composition of the invention is 0.1-1.0 mg/KOH, because if it is less than 0.1 the friction reducing effect of the additive will be undesirably reduced, and if it is greater than 1.0, corrosion of the sliding materials will increase and in terms of friction performance it will not be possible to maintain low friction for prolonged periods, which is also undesirable.

Component (B) according to the invention is an alkylamine represented by the following formula (3).

[Chemical Formula 4]

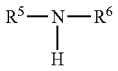

(3)

[In formula (3), $R^5$ and $R^6$ may be the same or different, and each represents hydrogen or a C4-30 branched-chain alkyl group, and at least one of $R^5$ and $R^6$ is a branched-chain alkyl group.]

The amine represented by formula (3) may be a monoamine, diamine or polyamine having one or more C4-30 and preferably C4-20 branched-chain alkyl groups, but it is preferably a monoamine having a C4-20 branched-chain alkyl group or a secondary amine of a monoamine having two C4-20 branched-chain alkyl groups. From the viewpoint of obtaining excellent low-temperature storage stability when mixed with component (A) and excellent low-friction performance when a cutting fluid is blended therewith, the branched-chain alkyl groups are more preferably C6 or greater branched-chain alkyl groups. From the viewpoint of solubility in the lubricating base oil, the branched-chain alkyl groups are preferably not greater than C20, more preferably not greater than C16 and even more preferably not greater than C14.

Specific preferred C4-20 branched-chain alkyl groups are branched-chain alkyl groups such as isobutyl, isopentyl, isohexyl, isooctyl, isononyl, isodecyl, isoundecyl, isododecyl, isotridecyl, isotetradecyl, isopentadecyl, isohexadecyl, isoheptadecyl, isooctadecyl, isononadecyl and isoeicosyl.

The content of component (B) in the lubricating oil composition of the invention will usually be 0.01-2% by mass based on the total weight of the composition, but from the viewpoint of excellent corrosion resistance when mixed with component (A), it is preferably 0.05% by mass or greater and most preferably 0.1% by mass or greater based on the total weight of the composition. From the viewpoint of low-temperature storage stability and excellent low-friction performance when a cutting fluid is blended therewith, the content of component (B) is not greater than 2% by mass, more preferably not greater than 1.0% by mass and most preferably not greater than 0.5% by mass, based on the total weight of the composition. The content of component (B) as nitrogen element will differ depending on the molecular weight of component (B), but it will usually be 0.0002-0.4% by mass, preferably 0.001-0.2% by mass and most preferably 0.002-0.1% by mass as nitrogen element, based on the total weight of the composition.

The optimal combination of component (A) and component (B) in the lubricating oil composition of the invention is a combination of an acidic phosphoric acid ester with a C6-18 straight-chain alkyl group and an amine with a C4-30 branched-chain alkyl group, and most preferably it is a combination of mono-n-octyl acid phosphate and/or di-n-octyl acid phosphate or monooleyl acid phosphate and/or dioleyl acid phosphate, with di-2-ethylhexylamine and/or diisotridecylamine.

The lubricating oil composition of the invention, comprising a specific lubricating base oil, component (A) and component (B), has an excellent low-friction property and excellent low-temperature storage stability, and can maintain machining accuracy without significant impairment of the initial low-friction property even when a cutting fluid is blended therewith.

The lubricating oil composition of the invention may also contain (C) a sulfur compound or other additives known in the field of lubricating oils, in order to increase its performance or to impart performance required of lubricating oil compositions for various purposes, and especially machine tool sliding surface lubricating oil compositions.

The lubricating oil composition of the invention preferably further comprises (C) a sulfur compound, from the viewpoint of obtaining excellent corrosion resistance, maintaining an even lower frictional coefficient, and helping to maintain machining accuracy for prolonged periods.

Examples of the (C) sulfur compound include sulfurized fats and oils, sulfurized fatty acids, sulfurized esters, olefin sulfides, dihydrocarbylpolysulfides, thiadiazole compounds, alkylthiocarbamoyl compounds, thiocarbamate compounds, thioterpene compounds, dialkylthiodipropionate compounds and the like. Any of these compounds may be used alone, or mixtures of two or more thereof may be used.

Sulfurized fats and oils are obtained by reacting sulfur or sulfur-containing compounds with fats or oils (lard oil, whale oil, vegetable oil, fish oil and the like), and although the sulfur content is not particularly restricted it is usually preferred to be 5-30% by mass. Specific examples include sulfurized lard, sulfurized rapeseed oil, sulfurized castor oil, sulfurized soybean oil, sulfurized rice bran oil, and mixtures of the foregoing.

Examples of sulfurized fatty acids include oleic sulfide and the like, and examples of sulfurized esters include sulfurized methyl oleate, sulfurized rice bran fatty acid octyl esters, and their mixtures.

Examples of olefin sulfides include compounds represented by the following formula (4):

$$R^7—S_a—R^8 \quad (4)$$

(wherein $R^7$ represents a C2-15 alkenyl group, $R^8$ represents a C2-15 alkyl group or alkenyl group, and a represents an integer of 1-8). The compound is obtained by reacting a C2-15 olefin or its 2-4-mer with a sulfidizing agent such as sulfur or sulfur chloride, where the olefin is preferably propylene, isobutene, diisobutene or the like.

A dihydrocarbylpolysulfide is a compound represented by the following formula (5):

$$R^9—S_b—R^{10} \quad (5)$$

(wherein $R^9$ and $R^{10}$ each represent a C1-20 alkyl or cycloalkyl group, a C6-20 aryl group, a C7-20 alkylaryl group or a C7-20 arylalkyl group, and may be the same or different, and b represents an integer of 1-8). When $R^9$ and $R^{10}$ are alkyl groups, the compound is an alkyl sulfide.

Specific examples for $R^9$ and $R^{10}$ in formula (5) above include methyl, ethyl, n-propyl, isopropyl, n-butyl, isobutyl, sec-butyl, tert-butyl, pentyls, hexyls, heptyls, octyls, nonyls, decyls, dodecyls, cyclohexyl, cyclooctyl, phenyl, naphthyl, tolyl, xylyl, benzyl and phenethyl.

Preferred examples of the dihydrocarbylpolysulfide include dibenzylpolysulfide, dinonylpolysulfides, didodecylpolysulfides, dibutylpolysulfides, dioctylpolysulfides, diphenylpolysulfide, dicyclohexylpolysulfide, and mixtures of the foregoing.

Examples of preferred thiadiazole compounds include 1,3,4-thiadiazoles, 1,2,4-thiadiazole compounds and 1,4,5-thiadiazoles represented by the following formulas (6), (7) and (8):

[Chemical Formula 5]

(6)

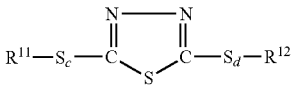

(7)

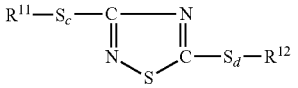

(8)

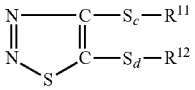

(wherein $R^{11}$ and $R^{12}$ each represent hydrogen or a C1-20 hydrocarbon group, and c and d each represent an integer of 0-8). Specific preferred examples of such thiadiazole compounds include 2,5-bis(n-hexyldithio)-1,3,4-thiadiazole, 2,5-bis(n-octyldithio)-1,3,4-thiadiazole, 2,5-bis(n-nonyldithio)-1,3,4-thiadiazole, 2,5-bis(1,1,3,3-tetramethylbutyldithio)-1,3,4-thiadiazole, 3,5-bis(n-hexyldithio)-1,2,4-thiadiazole, 3,5-bis(n-octyldithio)-1,2,4-thiadiazole, 3,5-bis(n-nonyldithio)-1,2,4-thiadiazole, 3,5-bis(1,1,3,3-tetramethylbutyldithio)-1,2,4-thiadiazole, 4,5-bis(n-hexyldithio)-1,2,3-thiadiazole, 4,5-bis(n-octyldithio)-1,2,3-thiadiazole, 4,5-bis(n-nonyldithio)-1,2,3-thiadiazole, 4,5-bis(1,1,3,3-tetramethylbutyldithio)-1,2,3-thiadiazole, and mixtures of the foregoing.

Examples of alkylthiocarbamoyl compounds include compounds represented by the following formula (9):

[Chemical Formula 6]

(9)

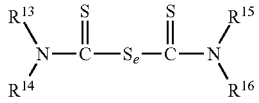

[wherein $R^{13}$-$R^{16}$ each represent a C1-20 alkyl group, and e represents an integer of 1-8]. Specific preferred examples of such alkylthiocarbamoyl compounds include bis(dimethylthiocarbamoyl)monosulfide, bis(dibutylthiocarbamoyl)monosulfide, bis(dimethylthiocarbamoyl)disulfide, bis(dibutylthiocarbamoyl)disulfide, bis(diamylthiocarbamoyl)disulfide, bis(dioctylthiocarbamoyl)disulfide, and mixtures of the foregoing.

Examples of alkylthiocarbamate compounds include compounds represented by the following formula (10):

[Chemical Formula 7]

(10)

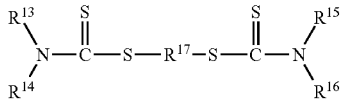

[wherein $R^{13}$-$R^{16}$ each represent a C1-20 alkyl group, and $R^{17}$ represents a C1-10 alkyl group]. Specific preferred examples of such alkylthiocarbamate compounds include methylenebis(dibutyl dithiocarbamate) and methylenebis[di(2-ethylhexyl) dithiocarbamate].

Examples of thioterpene compounds include reaction products of phosphorus pentasulfide and pinene, and examples of dialkylthiodipropionate compounds include dilaurylthiodipropionate, distearylthiodipropionate, and their mixtures.

The content of the (C) sulfur compound in the lubricating oil composition of the invention, from the viewpoint of the frictional properties of the obtained lubricating oil composition, is preferably 0.01% by mass or greater, more preferably 0.05% by mass or greater and even more preferably 0.1% by mass or greater, based on the total weight of the composition. Also, the content of sulfur-based additives is preferably not greater than 5% by mass, more preferably not greater than 3% by mass and even more preferably not greater than 2% by mass based on the total weight of the composition, from the viewpoint of excellent separability of the obtained lubricating oil composition from water-soluble cutting fluids, and because greater amounts will often fail to provide further improvement in the frictional properties.

Examples of other known additives include monohydric alcohols or polyhydric alcohols, monobasic or polybasic acids, esters of these alcohols and acids, oil agents including amine compounds such as amines and alkanolamines other than those of the present claim 1, antioxidants including phenol-based compounds such as di-tert-butyl-p-cresol and bisphenol A, and amine-based compounds such as phenyl-α-naphthylamine and N,N'-di(2-naphthyl)-p-phenylenediamine; metal inactivating agents such as benzotriazoles or alkylthiadiazoles; antifoaming agents such as silicone oils and fluorosilicon oils; phosphorus-based additives other than acid phosphates (orthophosphoric acid esters, phosphites, amine salts of acid phosphate or phosphite, and the like); oil agents such as carboxylic acids; rust-preventive additives such as alkenylsuccinic acids and sorbitan monooleate; pour point depressants such as polymethacrylates; and viscosity index improvers such as polymethacrylates, polybutenes, polyalkylstyrenes, olefin copolymers, styrene-diene copolymers and styrene-maleic anhydride copolymers.

The lubricating oil composition of the invention having the construction described above is excellent in terms of low-friction performance and low-temperature storage stability, does not notably impair the initial low-friction property even when a cutting fluid is blended therewith, and also exhibits excellent corrosion resistance. It can therefore be suitably used for various purposes in the field of lubricating oils in which low-friction properties, low-temperature storage stability and corrosion resistance are required. The effect of the invention is exhibited even more notably when it is used as a lubricating oil for sliding guide surfaces (sliding surfaces) of machine tools and the like.

EXAMPLES

The present invention will now be explained in greater detail based on examples and comparative examples, with the understanding that these examples are in no way limitative on the invention.

Examples A-1 to A-8 and Comparative Examples A-1 to A-4

The lubricating oil compositions listed in Tables 1 and 2 were prepared for Examples A-1 to A-8 and Comparative Examples A-1 to A-4. The components used to prepare each composition were as follows. The viscosity index for the purpose of the invention is the viscosity index measured according to JIS K 2283-1993. The saturated hydrocarbon component content is the weight percentage of saturated hydrocarbon components, fractionated by the silica-alumina gel chromatography method described in Analytical Chemistry, Vol. 44, No. 6 (1972), p. 915-919, "Separation of High-Boiling Petroleum Distillates Using Gradient Elution Through Dual-Packed (Silica Gel-Alumina Gel) Adsorption Columns" using n-hexane instead of the n-pentane that is used for elution of the saturated hydrocarbon components in the method, with respect to the total sample.

Lubricating Base Oil:

Base oil 1: Solvent refined mineral oil VG68 (viscosity index: 101, sulfur content: 0.51% by mass, saturated hydrocarbon content: 65.6 vol %, 40° C. kinematic viscosity: 68.7 $mm^2/s$, flash point 248° C., 15° C. density: 0.882 $g/cm^3$)

(A) Acid Phosphates:

A1: Mixture of mono-n-octyl acid phosphate and di-n-octyl acid phosphate (phosphorus content: 11.6% by mass)

A2: Mixture of monooleyl acid phosphate and dioleyl acid phosphate (phosphorus content: 6.6% by mass)

A3: Mono-n-hexyl acid phosphate (phosphorus content: 17% by mass)

A4: Mixture of mono-2-ethylhexyl acid phosphate and di-2-ethylhexyl acid phosphate (phosphorus content: 12.0% by mass)

(B) Alkylamines:

B1: Di-2-ethylhexylamine

B2: Diisotridecylamine

B3: 2-Ethylhexylamine

B4: Oleylamine (C) Sulfur Compounds:

C1: Polysulfide (sulfur content: 22.0% by mass)

C2: Sulfurized fats and oils (sulfur content: 11.4% by mass)

The lubricating oil compositions of each of Examples A-1 to A-8 and Comparative Examples A-1 to A-4 were then subjected to the following tests.

(Frictional Property Evaluation Test)

FIG. 1 is a general schematic drawing of a frictional coefficient measurement system used for the frictional property evaluation test. In FIG. 1, a table 1 and a movable jig 4 connected through a load cell 5 are placed on a bed 6, and a weight 9 is situated on the table 1 in place of a working tool. The table 1 and bed 6 are both made of cast iron. The movable jig 4 has a bearing section, and the bearing section is connected to an A/C servomotor 2 via a feed screw 3. The feed screw 3 is driven by the A/C servomotor 2, thus allowing the movable jig 4 to reciprocally move in the axial direction of the feed screw 3 (the direction of the arrows in the drawing). Also, the load cell 5 is electrically connected to a computer 7 while the computer 7 and A/C servomotor 2 are each electrically connected to a control panel 8, through which are effected control of the reciprocal movement of the movable jig 4 and measurement of the load between the table 1 and movable jig 4.

In this frictional coefficient measuring system, the lubricating oil composition is dropped on top of the bed 6, and the contact pressure between the table 1 and bed 6 is adjusted to 200 kPa by selecting the table weight 9, after which the movable jig 4 is reciprocally moved at a sliding rate of 0.1 mm/min and a sliding length of 15 mm. The load between the table 1 and the movable jig 4 during this time was measured with the load cell 5 (load meter), and the measured value was used to determine the frictional coefficient of the guide surface (table 1/bed 6=cast iron/cast iron). The test was carried out after 3 warm-up runs. The frictional coefficients of the obtained lubricating oil compositions are shown in Tables 1 and 2.

(Frictional Property Evaluation Test with Cutting Fluid Blending)

In a 1000 mL beaker there were placed 500 mL of the lubricating oil composition and 25 mL of a water-soluble cutting fluid (emulsion-type cutting fluid by Nippon Oil Corp., corresponding to Type W1#1 Product according to "Cutting Fluids" of JISK 2241, dilution ratio: 10×). The mixture was gently stirred in the beaker with a magnetic rotor for 1 minute at room temperature. After stirring, it was allowed to stand for 1 hour and the upper layer was used as the measuring sample. The results of the frictional property evaluation test described above are shown in Tables 1 and 2. With blending of the cutting fluid, a frictional coefficient of greater than 0.110 was judged as outside of the allowable range, a value of up to 0.110 was judged as within the allowable range, and a value of up to 0.09 was judged as highly superior.

(Phosphorus Residue with Blending of Cutting Fluid)

In a 1000 mL beaker there were placed 500 mL of the lubricating oil composition and 25 mL of a water-soluble cutting fluid (emulsion-type cutting fluid by Nippon Oil Corp., corresponding to Type W1#1 Product according to "Cutting Fluids" of JISK 2241, dilution ratio: 10×). The mixture was gently stirred in the beaker with a magnetic rotor for 1 minute at room temperature. After stirring, it was allowed to stand for 1 hour and the upper layer (oil layer) was used as the measuring sample for quantitative analysis of the P content based on "Lubricating Oils—Determination of Additive Elements—Inductively Coupled Plasma Atomic Emission Spectrometry" of JPI test method 5S-38-03 of the Japan Petroleum Institute. The value of (phosphorus content before test/phosphorus content after test)×100 was calculated as the phosphorus residue (%). The obtained results are shown in Tables 1 and 2.

(Corrosion Resistance Test with Blending of Cutting Fluid)

In a 1000 mL beaker there were placed 500 mL of the lubricating oil composition and 25 mL of a water-soluble cutting fluid (emulsion-type cutting fluid by Nippon Oil Corp., corresponding to Type W1#1 Product according to "Cutting Fluids" of JISK 2241, dilution ratio: 10×). The mixture was gently stirred in the beaker with a magnetic rotor for 1 minute at room temperature. After stirring, it was allowed to stand for 1 hour and used as the measuring sample, placing 200 ml in a glass beaker, and immersing a methanol-degreased 7 cm-square SPC material (thickness: 0.2 mm, #80 dull finish) in the container at ordinary temperature. After 20 days had elapsed, the test piece was rinsed with solvent and then the outer appearance was visually observed, evaluating the corrosion resistance based on the presence or absence of discoloration at the gas/liquid boundary. The evaluation criteria were as follows. The obtained results are shown in Tables 1 and 2.

A: No discoloration

B: Tendency toward some discoloration

C: Distinct discoloration

TABLE 1

| | | | Example A-1 | Example A-2 | Example A-3 | Example A-4 | Example A-5 | Example A-6 | Example A-7 | Example A-8 |
|---|---|---|---|---|---|---|---|---|---|---|
| Composition [% by mass] | Base oil | Base oil 1 | remainder | remainder | remainder | remainder | remainder | remainder | remainder | remainder |
| | Component (A) | A1 | 0.1 | — | 0.1 | 0.1 | 0.1 | 0.1 | 0.1 | 0.1 |
| | | A2 | — | 0.2 | — | — | 0.2 | 0.2 | 0.2 | 0.2 |
| | | A3 | — | — | — | — | — | — | — | — |
| | | A4 | — | — | — | — | — | — | — | 0.5 |
| | Component (B) | B1 | 0.05 | 0.1 | — | — | 0.15 | 0.15 | — | — |
| | | B2 | — | — | 0.1 | — | — | — | 0.2 | 0.2 |
| | | B3 | — | — | — | 0.1 | — | — | — | — |
| | | B4 | — | — | — | — | — | — | — | — |
| | Component (C) | C1 | — | — | — | — | — | 1.0 | — | — |
| | | C2 | — | — | — | — | — | — | — | 0.5 |
| Acid value due to component (A) [mgKOH/g] | | | 0.33 | 0.33 | 0.32 | 0.33 | 0.66 | 0.66 | 0.66 | 0.65 |
| Frictional coefficient | | | 0.080 | 0.075 | 0.080 | 0.080 | 0.075 | 0.065 | 0.070 | 0.075 |
| Frictional coefficient when blended with cutting fluid | | | 0.085 | 0.085 | 0.085 | 0.090 | 0.080 | 0.075 | 0.080 | 0.080 |
| Phosphorus residue when blended with cutting fluid [%] | | | 75 | 70 | 80 | 70 | 75 | 80 | 80 | 80 |
| Corrosion resistance when blended with cutting fluid | | | A | A | A | A | A | A | A | A |

TABLE 2

| | | | Comp. Ex. A-1 | Comp. Ex. A-2 | Comp. Ex. A-3 | Comp. Ex. A-4 |
|---|---|---|---|---|---|---|
| Composition [% by mass] | Base oil | Base oil 1 | remainder | remainder | remainder | remainder |
| | Component (A) | A1 | — | — | — | — |
| | | A2 | — | — | — | — |
| | | A3 | 0.2 | — | — | 0.6 |
| | | A4 | — | 0.3 | 0.3 | — |
| | Component (B) | B1 | — | — | 0.25 | 0.5 |
| | | B2 | — | — | — | — |
| | | B3 | — | — | — | — |
| | | B4 | 0.3 | 0.3 | — | — |
| | Component (C) | C1 | — | — | — | — |
| | | C2 | — | — | — | — |
| Acid value due to component (A) [mgKOH/g] | | | 0.77 | 0.96 | 0.96 | 2.30 |
| Frictional coefficient | | | 0.105 | 0.140 | 0.135 | 0.095 |
| Frictional coefficient when blended with cutting fluid | | | 0.125 | 0.150 | 0.145 | 0.135 |
| Phosphorus residue when blended with cutting fluid [%] | | | 65 | 65 | 75 | 65 |
| Corrosion resistance when blended with cutting fluid | | | A | A | A | B |

As is clear from the results shown in Tables 1 and 2, the lubricating oil compositions of Examples A-1 to A-8 were superior to the compositions of Comparative Examples A-1 to A-4 in terms of low-friction performance (low frictional coefficient), maintaining low-friction performance when blended with cutting fluids, and exhibiting satisfactory corrosion resistance as well.

Examples B-1 to B-11

Lubricating oil compositions having the compositions listed in Tables 3 and 4 were prepared for Examples B-1 to B-11. The components used to prepare each lubricating oil composition were as follows.

Lubricating Base Oil:

Base oil 1: Poly-α-olefin VG32 (viscosity index: 138, sulfur content: <1 ppm by mass, 40° C. kinematic viscosity: 31.00 $mm^2/s$, flash point: 246° C., 15° C. density: 0.827 $g/cm^3$, nitrogen content: <3 ppm)

Base oil 2: Wax isomerized base oil VG32 (viscosity index: 154, sulfur content: <1 ppm by mass, saturated hydrocarbon content: 99.1% by mass, 40° C. kinematic viscosity: 31.10 $mm^2/s$, 100° C. kinematic viscosity: 6.215 $mm^2/s$, aniline point: 124.9° C., flash point 258° C., 15° C. density: 0.827 $g/cm^3$, nitrogen content: <3 ppm)

Base oil 3: Hydrorefined base oil VG32 (viscosity index: 135, sulfur content: 0.01% by mass, saturated hydrocarbon content: 97.4% by mass, 40° C. kinematic viscosity: 31.11 $mm^2/s$ flash point: 246° C., 15° C. density: 0.840 $g/cm^3$, nitrogen content: <3 ppm)

Base oil 4: Poly-α-olefin VG68 (viscosity index: 150, sulfur content: <1 ppm by mass, 40° C. kinematic viscosity: 69.90 $mm^2/s$, flash point: 270° C., 15° C. density: 0.842 $g/cm^3$, nitrogen content: <3 ppm)

Base oil 5: Hydrorefined base oil VG68 (viscosity index: 110, sulfur content: 0.08% by mass, saturated hydrocarbon content: 76.9% by mass, 40° C. kinematic viscosity: 66.09 $mm^2/s$ flash point: 258° C., 15° C. density: 0.869 $g/cm^3$, nitrogen content: 10 ppm)

Base oil 6: Poly-α-olefin VG220 (viscosity index: 141, sulfur content: <1 ppm, 40° C. kinematic viscosity: 216.0 $mm^2/s$, flash point: 262° C., 15° C. density: 0.842 $g/cm^3$, nitrogen content: <3 ppm)

Base oil 7: Solvent refined mineral oil VG32 (viscosity index: 102, sulfur content: 0.27% by mass, saturated hydrocarbon content: 67.0% by mass, 40° C. kinematic viscosity: 31.54 $mm^2/s$ flash point: 220° C., 15° C. density: 0.844 $g/cm^3$, nitrogen content: 30 ppm)

Base oil 8: Solvent refined base oil VG68 (viscosity index: 98, sulfur content: 0.62% by mass, saturated hydrocarbon content: 63.9% by mass, 40° C. kinematic viscosity: 68.69 $mm^2/s$ flash point: 252° C., 15° C. density: 0.885 $g/cm^3$, nitrogen content: 40 ppm)

Base oil 9: Solvent refined mineral oil VG220 (viscosity index: 95, sulfur content: 0.56% by mass, saturated hydrocarbon content: 60.1% by mass, 40° C. kinematic viscosity: 215.9 $mm^2/s$ flash point: 270° C., 15° C. density: 0.894 $g/cm^3$, nitrogen content: 110 ppm)

The notations VG32, VG68 and VG220 for the base oils are the viscosity grades according to JIS K 2001, "Industrial Lubricants—ISO Viscosity Classification".

(A) Acid Phosphates:

A1: Mixture of mono-n-octyl acid phosphate and di-n-octyl acid phosphate (phosphorus content: 11.6% by mass)

A2: Mixture of monooleyl acid phosphate and dioleyl acid phosphate (phosphorus content: 6.6% by mass)

(B) Alkylamines:

B1: Di-2-ethylhexylamine

Other Additives:

C1: Polysulfide (sulfur content: 22.0% by mass)

Each of the lubricating oil compositions of Examples B-1 to B-11 were then subjected to a frictional property evaluation test, a frictional property evaluation test with cutting fluid blending, phosphorus residue measurement with cutting fluid blending and a corrosion resistance test with cutting fluid blending, in the same manner as Examples A-1 to A-8. The obtained results are shown in Tables 3 and 4.

TABLE 3

| | | | Example B-1 | Example B-2 | Example B-3 | Example B-4 | Example B-5 | Example B-6 |
|---|---|---|---|---|---|---|---|---|
| Composition, % by mass | Lubricant base oil | Base oil 1 | remainder | — | — | — | — | — |
| | | Base oil 2 | — | remainder | — | — | — | — |
| | | Base oil 3 | — | — | remainder | — | — | — |
| | | Base oil 4 | — | — | — | remainder | — | remainder |
| | | Base oil 5 | — | — | — | — | remainder | — |
| | | Base oil 6 | — | — | — | — | — | — |
| | | Base oil 7 | — | — | — | — | — | — |
| | | Base oil 8 | — | — | — | — | — | — |
| | | Base oil 9 | — | — | — | — | — | — |
| | Component (A) | A1 | 0.1 | 0.1 | 0.1 | 0.1 | 0.1 | 0.1 |
| | | A2 | 0.2 | 0.2 | 0.2 | — | — | 0.2 |
| | Component (B) | B1 | 0.15 | 0.15 | 0.15 | 0.05 | 0.05 | 0.15 |
| | Other additives | C1 | 1.0 | 1.0 | 1.0 | — | — | 1.0 |
| Acid value due to component (A), mgKOH/g | | | 0.66 | 0.66 | 0.33 | 0.33 | 0.33 | 0.66 |
| Frictional coefficient | | | 0.060 | 0.060 | 0.070 | 0.075 | 0.070 | 0.065 |
| Frictional coefficient when blended with cutting fluid | | | 0.075 | 0.065 | 0.080 | 0.080 | 0.080 | 0.070 |
| Phosphorus residue when blended with cutting fluid, % by mass | | | 75 | 80 | 75 | 75 | 80 | 80 |
| Corrosion resistance when blended with cutting fluid | | | A | A | A | A | A | A |

TABLE 4

| | | | Example B-7 | Example B-8 | Example B-9 | Example B-10 | Example B-11 |
|---|---|---|---|---|---|---|---|
| Composition, wt % | Lubricant base oil | Base oil 1 | — | — | — | — | — |
| | | Base oil 2 | — | — | — | — | — |
| | | Base oil 3 | — | — | — | — | — |
| | | Base oil 4 | — | — | — | — | — |
| | | Base oil 5 | remainder | — | — | — | — |
| | | Base oil 6 | — | remainder | — | — | — |
| | | Base oil 7 | — | — | remainder | — | — |
| | | Base oil 8 | — | — | — | remainder | — |
| | | Base oil 9 | — | — | — | — | remainder |
| | Component (A) | A1 | 0.1 | 0.1 | 0.1 | 0.1 | 0.1 |
| | | A2 | 0.2 | 0.2 | 0.2 | 0.2 | 0.2 |
| | Component (B) | B1 | 0.15 | 0.15 | 0.15 | 0.15 | 0.15 |
| | Other additives | C1 | 1.0 | 1.0 | 1.0 | 1.0 | 1.0 |
| Acid value due to component (A), mgKOH/g | | | 0.66 | 0.66 | 0.66 | 0.66 | 0.66 |
| Frictional coefficient | | | 0.060 | 0.080 | 0.085 | 0.090 | 0.095 |
| Frictional coefficient when blended with cutting fluid | | | 0.070 | 0.095 | 0.090 | 0.095 | 0.100 |
| Phosphorus residue when blended with cutting fluid, wt % | | | 80 | 75 | 80 | 75 | 75 |
| Corrosion resistance when blended with cutting fluid | | | A | A | A | A | A |

The invention claimed is:

1. A method for lubricating a machine tool sliding guide surface comprising:

lubricating a machine tool sliding guide surface with a lubricating oil composition comprising:

a lubricating base oil and a mixture and/or a reaction product of (A) 0.01-0.5% by mass of at least one compound selected from among acid phosphates represented by the following formula (1) or (2), and (B) 0.01-2% by mass of an alkylamine represented by the following formula (3), based on the total weight of the composition, wherein the acid value due to component (A) is 0.1-1.0 mgKOH/g and the acid phosphates of component (A) are a mixture of a phosphoric acid monoester and a phosphoric acid diester;

(1)

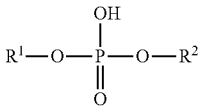

(2)

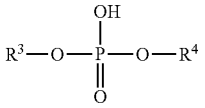

(3)

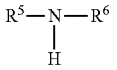

wherein $R^1$ and $R^2$ may be the same or different, and each represents hydrogen or a straight-chain alkyl, and at least one of $R^1$ and $R^2$ is a C6-12 straight-chain alkyl;

wherein $R^3$ and $R^4$ may be the same or different, and each represents hydrogen or a straight-chain alkenyl group, and at least one of $R^3$ and $R^4$ is a C13-18 straight-chain alkyl or a straight-chain alkenyl group; and wherein $R^5$ and $R^6$ may be the same or different, and each represents hydrogen or a C6-14 branched-chain alkyl group, and at least one of $R^5$ and $R^6$ is a branched-chain alkyl group.

2. A lubricating oil composition comprising:

a lubricating base oil and a mixture or a mixture and a reaction product of (A) 0.01-0.5% by mass based on the total weight of the composition of at least one compound selected from among acid phosphates represented by the following formula (1) or (2), and (B) 0.01-2% by mass based on the total weight of the composition of an alkylamine represented by the following formula (3), wherein the acid value due to component (A) is 0.1-1.0 mgKOH/g and the acid phosphates of component (A) are a mixture of a phosphoric acid monoester and a phosphoric acid diester;

(1)

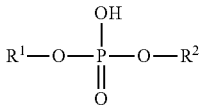

(2)

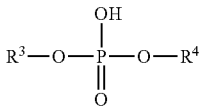

(3)

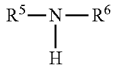

wherein $R^1$ and $R^2$ may be the same or different, and each represents hydrogen or a straight-chain alkyl or a straight-chain alkenyl group, and at least one of $R^1$ and $R^2$ is a C6-12 straight-chain alkyl or a straight-chain alkenyl group;

wherein $R^3$ and $R^4$ may be the same or different, and each represents hydrogen or a straight-chain alkyl or a straight-chain alkenyl group, and at least one of $R^3$ and $R^4$ is a C13-18 straight-chain alkyl or a straight-chain alkenyl group; and wherein $R^5$ and $R^6$ may be the same or different, and each represents hydrogen or a C4-30 branched-chain alkyl group, and at least one of $R^5$ and $R^6$ is a branched-chain alkyl group.

* * * * *